US010344770B2

(12) United States Patent
Kozaki

(10) Patent No.: US 10,344,770 B2
(45) Date of Patent: Jul. 9, 2019

(54) TEMPERATURE CONTROL DEVICE AND TURBO-MOLECULAR PUMP

(71) Applicant: Shimadzu Corporation, Kyoto (JP)

(72) Inventor: Junichiro Kozaki, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 247 days.

(21) Appl. No.: 15/392,524

(22) Filed: Dec. 28, 2016

(65) Prior Publication Data

US 2017/0260999 A1 Sep. 14, 2017

(30) Foreign Application Priority Data

Mar. 14, 2016 (JP) ..... 2016-050292

(51) Int. Cl.
*F04D 19/04* (2006.01)
*F04D 29/32* (2006.01)
(Continued)

(52) U.S. Cl.
CPC ..... *F04D 29/324* (2013.01); *F04D 19/042* (2013.01); *F04D 27/006* (2013.01);
(Continued)

(58) Field of Classification Search
CPC .... F04D 29/324; F04D 29/584; F04D 19/042; F04D 27/006; F04D 27/0276; F05D 2260/607
(Continued)

(56) References Cited

U.S. PATENT DOCUMENTS 6,416,290 B1 7/2002 Yamauchi
7,090,469 B2 * 8/2006 Blumenthal ..... F04D 19/042 417/32
(Continued)

FOREIGN PATENT DOCUMENTS

CN 104350283 A 11/2015
JP 10-266991 A 10/1998
(Continued)

OTHER PUBLICATIONS

Office Action dated Oct. 29, 2018 for corresponding Chinese Application No. 201611191535.7. English language machine translation.

*Primary Examiner* — Ninh H. Nguyen
(74) *Attorney, Agent, or Firm* — Renner, Otto, Boisselle & Sklar, LLP

(57) ABSTRACT

A turbo-molecular pump includes a stator provided at a pump base portion, a rotor rotatably driven on the stator, a heating section configured to heat the pump base portion, abase temperature detection section configured to detect a temperature of the pump base portion, and a rotor temperature detection section configured to detect a temperature equivalent as a physical amount equivalent to a temperature of the rotor. A temperature control device of the turbo-molecular pump comprises: a heating control section configured to control heating of the pump base portion by the heating section based on a detection value of the rotor temperature detection section; and an informing section configured to inform a warning when a detection temperature of the base temperature detection section is equal to or lower than a predetermined threshold.

7 Claims, 10 Drawing Sheets

(51) Int. Cl.
*F04D 27/00* (2006.01)
*F04D 29/58* (2006.01)
*F04D 27/02* (2006.01)

(52) U.S. Cl.
CPC ..... *F04D 27/0276* (2013.01); *F04D 29/584* (2013.01); *F05D 2260/607* (2013.01)

(58) Field of Classification Search
USPC ..... 415/90
See application file for complete search history.

(56) References Cited

U.S. PATENT DOCUMENTS

| | | | | |
|---|---|---|---|---|
| 7,965,054 | B2 * | 6/2011 | Tsunazawa | F04D 19/042 318/471 |
| 8,256,954 | B2 * | 9/2012 | Giors | F04D 19/042 374/163 |
| 2003/0175131 | A1 * | 9/2003 | Ishikawa | F04D 19/04 417/353 |
| 2008/0131288 | A1 * | 6/2008 | Kozaki | F04D 19/042 417/32 |
| 2015/0226229 | A1 | 8/2015 | Tsutsui | |

FOREIGN PATENT DOCUMENTS

| | | | |
|---|---|---|---|
| JP | 2006-017089 | A | 1/2006 |
| JP | 2006-083825 | A | 3/2006 |

* cited by examiner

TEMPERATURE CONTROL DEVICE AND TURBO-MOLECULAR PUMP

BACKGROUND OF THE INVENTION

1. Technical Field

The present invention relates to a temperature control device and a turbo-molecular pump.

2. Background Art

A turbo-molecular pump has been used as an exhaust pump for various semiconductor manufacturing devices. However, when exhausting is performed in, e.g., an etching process, a reactive product is accumulated in the pump. In particular, the reactive product tends to be accumulated in a gas flow path on a pump downstream side. When the reactive product is accumulated to such an extent that a clearance between a rotor and a stator is filled with the accumulated substance, various troubles are caused. For example, the rotor is fixed to the stator, and as a result, becomes unable to rotate. In addition, a rotor blade(s) comes into contact with a stator side, and as a result, is damaged. Thus, a turbo-molecular pump configured such that accumulation of a reactive product is reduced by heating of a pump base portion has been known (see, e.g., Patent Literature 1 (JP-A-10-266991)).

The turbo-molecular pump described in Patent Literature 1 includes a base temperature setting unit configured to set a target temperature of the base portion based on the temperature of the rotary blade obtained by a rotary blade temperature detection unit, a temperature difference calculation unit configured to calculate a difference between the target temperature set by the base temperature setting unit and an actual temperature measured at the base portion, and a temperature control unit configured to control heating or cooling of the base portion based on an output signal of the temperature difference calculation unit. For preventing an abnormal temperature of the rotary blade when accumulation of the product is prevented by heating of the base portion, the target temperature of the base portion is set based on the temperature of the rotary blade obtained by the rotary blade temperature detection unit. In this manner, the rotary blade is protected while accumulation of the reactive product is prevented.

However, even when the target temperature of the base portion is set such that the abnormal temperature of the rotary blade is prevented, it is difficult to completely prevent accumulation of the reactive product, and accumulation of the reactive product cannot be avoided. For these reasons, the amount of accumulation of the reactive product increases as a pump operation time proceeds. Eventually, the problem of fixing the rotor to the stator with the reactive product is caused.

SUMMARY OF THE INVENTION

A turbo-molecular pump includes a stator provided at a pump base portion, a rotor rotatably driven on the stator, a heating section configured to heat the pump base portion, abase temperature detection section configured to detect a temperature of the pump base portion, and a rotor temperature detection section configured to detect a temperature equivalent as a physical amount equivalent to a temperature of the rotor. A temperature control device of the turbo-molecular pump comprises: a heating control section configured to control heating of the pump base portion by the heating section based on a detection value of the rotor temperature detection section; and an informing section configured to inform a warning when a detection temperature of the base temperature detection section is equal to or lower than a predetermined threshold.

The heating control section controls the heating of the pump base portion by the heating section such that the detection value of the rotor temperature detection section reaches a predetermined target value.

The rotor temperature detection section includes a ferromagnetic target provided at the rotor, and a sensor disposed to face the ferromagnetic target to detect a magnetic permeability change of the ferromagnetic target, and the temperature of the rotor is detected based on the magnetic permeability change of the ferromagnetic target around a Curie point thereof.

A turbo-molecular pump includes a stator provided at a pump base portion, a rotor rotatably driven on the stator, a heating section configured to heat the pump base portion, and a rotor temperature detection section configured to detect a temperature equivalent as a physical amount equivalent to a temperature of the rotor. A temperature control device of a turbo-molecular pump controls heating of the pump base portion by the heating section such that a detection value of the rotor temperature detection section reaches a predetermined target value.

The rotor temperature detection section includes a ferromagnetic target provided at the rotor, and a sensor disposed to face the ferromagnetic target to detect a magnetic permeability change of the ferromagnetic target, and the temperature of the rotor is detected based on the magnetic permeability change of the ferromagnetic target around a Curie point thereof.

According to the present invention, a warning against accumulation of a reactive product is informed so that maintenance can be properly performed. In addition, a rotor life and a maintenance period can be extended.

DETAILED DESCRIPTION OF THE EXEMPLARY EMBODIMENTS

Figure 1:
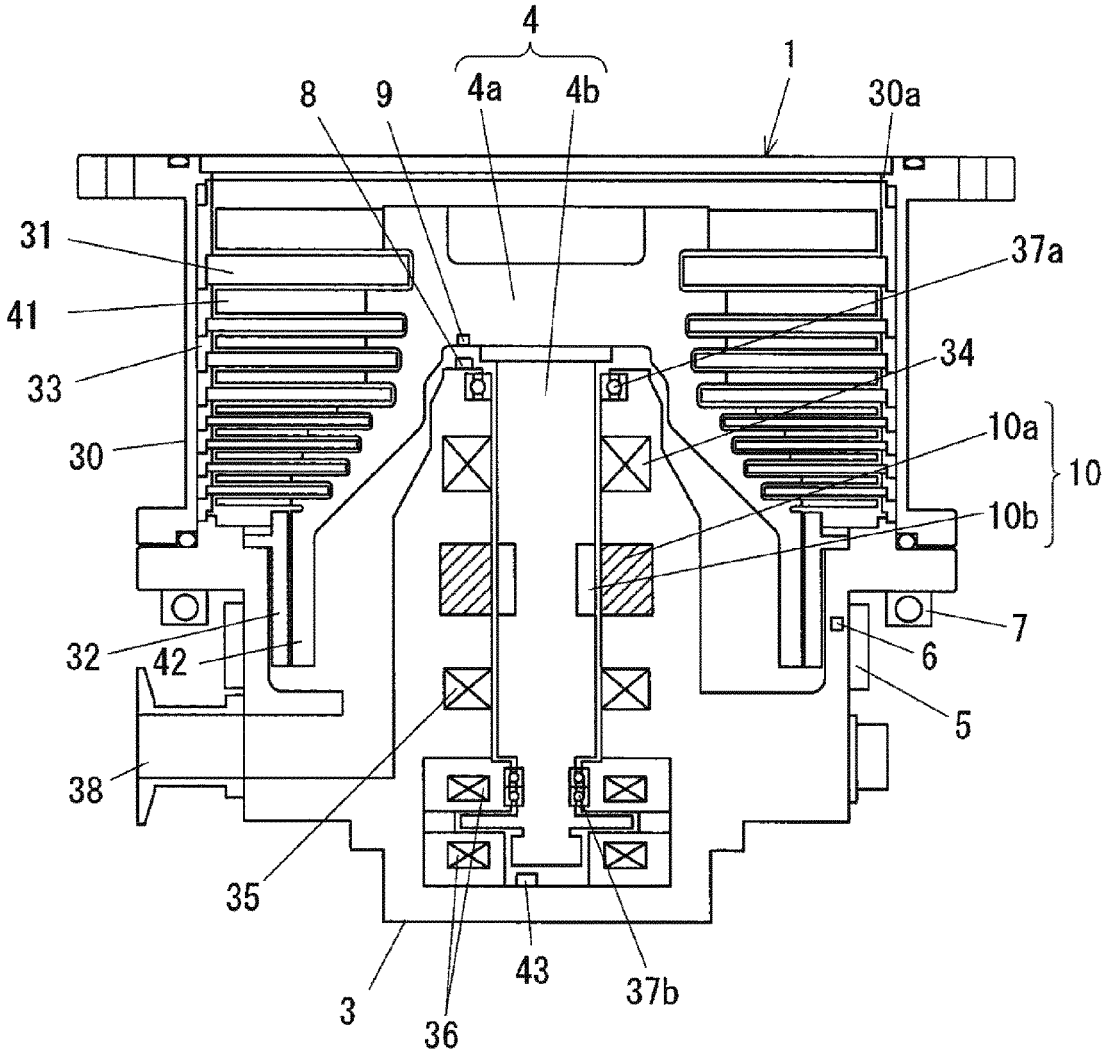
FIG. 1 is a cross-sectional view of an outline configuration of a pump main body of a turbo-molecular pump.

Hereinafter, embodiments of the present invention will be described with reference to the drawings. FIG. 1 is a view of an embodiment of the present invention, and is a cross-sectional view of an outline configuration of a pump main body 1 of a turbo-molecular pump. The pump main body 1 is controlled by a not-shown control unit.

The pump main body 1 includes a turbo pump stage having rotor blades 41 and stationary blades 31, and a screw groove pump stage having a cylindrical portion 42 and a stator 32. In the screw groove pump stage, a screw groove is formed at the stator 32 or the cylindrical portion 42. The rotor blades 41 and the cylindrical portion 42 are provided at a pump rotor 4*a*. The pump rotor 4*a* is fastened to a shaft 4*b*. The pump rotor 4*a* and the shaft 4*b* form a rotor unit 4.

The rotor blades 41 arranged in an axial direction and the stationary blades 31 are alternately arranged. Each stationary blade 31 is placed on a base 3 with a corresponding one of spacer rings 33 being interposed therebetween. When a pump casing 30 is bolted to the base 3, the stack of the spacer rings 33 is sandwiched between the base 3 and a lock portion 30*a* of the pump casing 30, thereby positioning the stationary blades 31.

The shaft 4*b* is non-contact supported by magnetic bearings 34, 35, 36 provided at the base 3. Although not specifically shown in the figure, each of the magnetic bearings 34 to 36 includes an electromagnet and a displacement sensor. The levitation position of the shaft 4*b* is detected by the displacement sensor. The rotation speed (the rotation speed per second) of the shaft 4*b*, i.e., the rotor unit 4, is detected by a rotation sensor 43.

The shaft 4*b* is rotatably driven by a motor 10. The motor 10 includes a motor stator 10*a* provided at the base 3, and a motor rotor 10*b* provided at the shaft 4*b*. When no magnetic bearings operate, the shaft 4*b* is supported by emergency mechanical bearings 37*a*, 37*b*. When the motor 10 rotates the rotor unit 4 at high speed, gas on a pump suction port side is sequentially exhausted by the turbo pump stage (the rotor blades 41, the stationary blades 31) and the screw groove pump stage (the cylindrical portion 42, the stator 32), and then, is discharged through an exhaust port 38.

The base 3 is provided with a heater 5 and a cooling device 7, these components being configured to adjust the temperature of the stator 32. In an example illustrated in FIG. 1, a cooling block provided with a flow path through which refrigerant circulates is provided as the cooling device 7. Although not shown in the figure, an electromagnetic valve configured to control ON/OFF of refrigerant inflow is provided at the refrigerant flow path of the cooling device 7. The base 3 is further provided with a base temperature sensor 6. Note that in the example illustrated in FIG. 1, the base temperature sensor 6 is provided at the base 3, but may be provided at the stator 32.

Moreover, the temperature of the pump rotor 4*a* is detected by a rotor temperature sensor 8. As described above, the pump rotor 4*a* is magnetically levitated, and then, rotates at high speed. Thus, a non-contact temperature sensor is used as the rotor temperature sensor 8. In the present embodiment, the rotor temperature sensor 8 is an inductance sensor, and is configured to detect, as an inductance change, a change in the magnetic permeability of a target 9 provided at the pump rotor 4*a*. The target 9 is formed of a ferromagnetic body.

Figure 2:
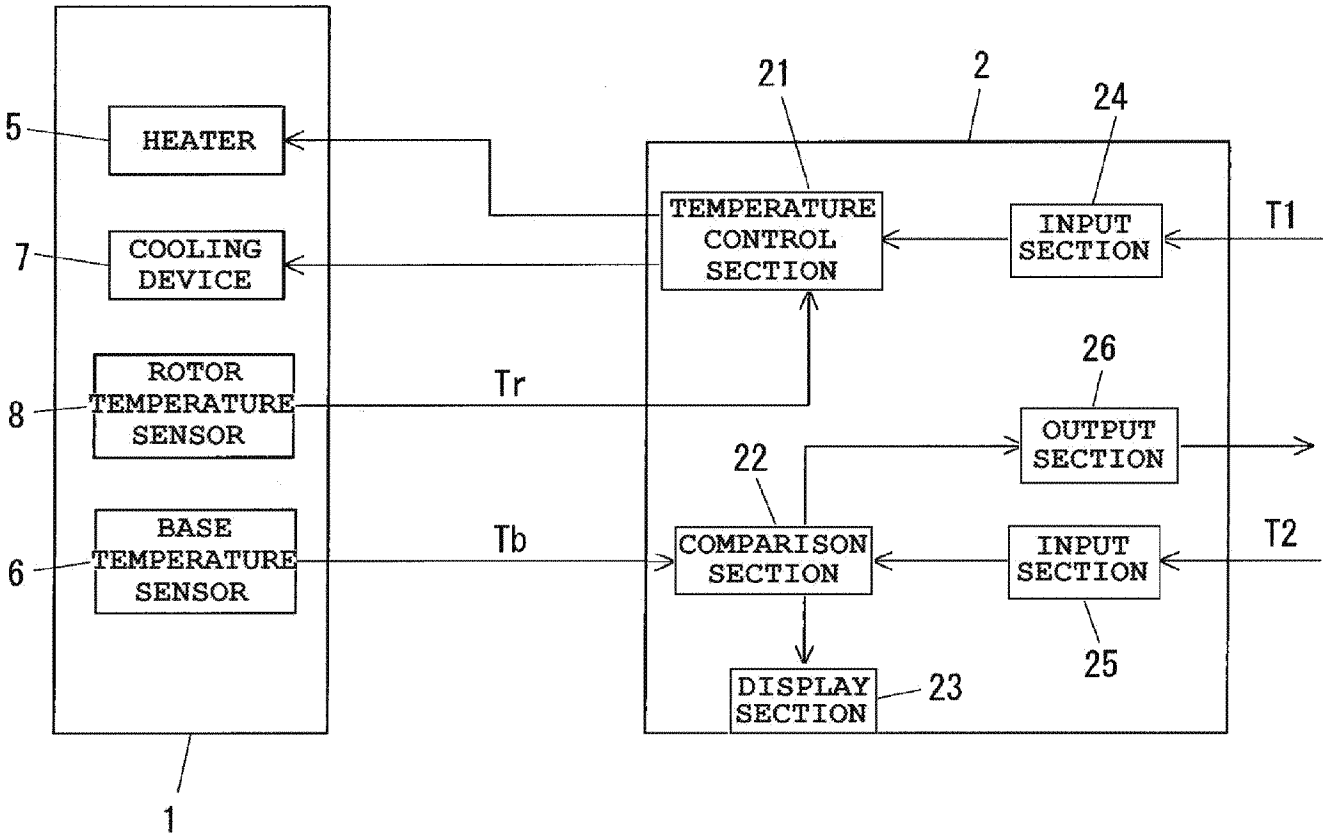
FIG. 2 is a block diagram of a temperature control device 2.

FIG. 2 is a block diagram of a temperature control device 2. As described above, the pump main body 1 is provided with the heater 5 and the cooling device 7 for temperature adjustment and the base temperature sensor 6, as well as being provided with the rotor temperature sensor 8 configured to detect the temperature of the pump rotor 4*a*. These components are connected to the temperature control device 2.

The temperature control device 2 includes a temperature control section 21, a comparison section 22, a display section 23, input sections 24, 25, and an output section 26. The temperature control section 21 is configured to control heating by the heater 5 and cooling by the cooling device 7 based on a rotor temperature Tr detected by the rotor temperature sensor 8 and a predetermined temperature T1 input to the input section 24. Specifically, ON/OFF control of the heater 5 and ON/OFF control of refrigerant inflow of the cooling device 7 are performed. Note that in the present embodiment, temperature adjustment is performed using the heater 5 and the cooling device 7, but may be performed only by ON/OFF of the heater 5.

The comparison section 22 is configured to display, on the display section 23, a warning against accumulation of a reactive product based on a base temperature Tb detected by the base temperature sensor 6 and a predetermined temperature T2 input to the input section 25. Examples of the method for inputting the predetermined temperature T1, T2 to the input section 24, 25 include a configuration in which the predetermined temperature T1, T2 is manually input by operator's operation of an operation section provided at the input section 24, 25. Alternatively, it may be configured such that the predetermined temperature T1, T2 is set by a command from a high-order controller. Note that unless otherwise externally set, standard values stored in advance may be applied as T1, T2.

(Description of Temperature Adjustment Operation and Warning Operation)

Next, temperature adjustment operation and warning operation by the temperature control device 2 will be described in detail. As described above, in exhausting at, e.g., an etching process, the reactive product is accumulated in the pump. In particular, the reactive product tends to be accumulated in the gas flow path at the stator 32, the cylindrical portion 42, and the base 3 on a pump downstream side. With an increase in accumulation at the stator 32 and the cylindrical portion 42, a clearance between the stator 32 and the cylindrical portion 42 is narrowed by the accumulated substance, and for this reason, the stator 32 and the cylindrical portion 42 might contact each other or might be fixed together. For this reason, the heater 5 and the cooling device 7 are provided to control the temperature of the base portion to reduce accumulation of the reactive product in the gas flow path at the stator 32, the cylindrical portion 42, and the base 3. This temperature adjustment operation will be described later.

Generally, an aluminum material is used for the pump rotor 4*a* of the turbo-molecular pump, and therefore, the temperature (the rotor temperature Tr) of the pump rotor 4*a* includes an allowable temperature for creep stain, the allowable temperature being unique to the aluminum material. Since the pump rotor 4*a* rotates at high speed in the turbo-molecular pump, a high centrifugal force acts on the pump rotor 4*a* in a high-speed rotation state, leading to a high tensile stress state. In such a high tensile stress state, when the temperature of the pump rotor 4*a* reaches equal to or higher than the allowable temperature (e.g., 120° C.), the speed of creep deformation increasing permanent strain can no longer be ignored.

When operation continues at equal to or higher than the allowable temperature, the creep strain of the pump rotor 4*a* increases, and accordingly, the diameter dimension of each portion of the pump rotor 4*a* increases. Thus, the clearance between the cylindrical portion 42 and the stator 32 and a clearance among the rotor blades 41 and the stationary blades 31 are narrowed, leading to the probability of causing contact among these components. Considering the creep strain of the pump rotor 4*a*, operation is preferably performed at equal to or lower than the allowable temperature. On the other hand, for reducing accumulation of the reactive product to further extend a maintenance interval for removal of the accumulated substance, the base temperature Tb is preferably held higher by temperature adjustment.

Although will be described in detail later, the heater 5 and the cooling device 7 are, in the present embodiment, controlled such that the rotor temperature Tr detected by the rotor temperature sensor 8 reaches a predetermined temperature or falls within a predetermined temperature range. In this manner, a proper temperature placing a priority on extension of the life of the pump rotor 4*a* against the creep strain is maintained while the interval of maintenance against accumulation of the reactive product is extended.

Figure 3A:
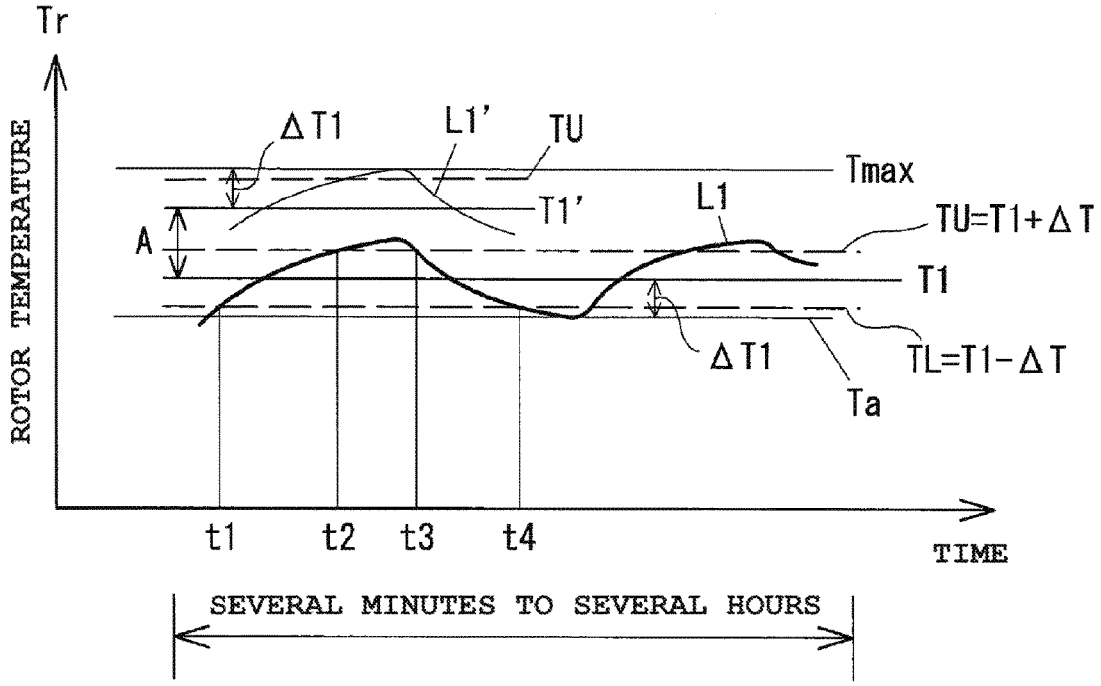
FIGS. 3(*a*) and 3(*b*) are graphs of an example of transition of a rotor temperature Tr and a base temperature Tb when control is made such that the rotor temperature Tr reaches a predetermined temperature T1.
Figure 3B:
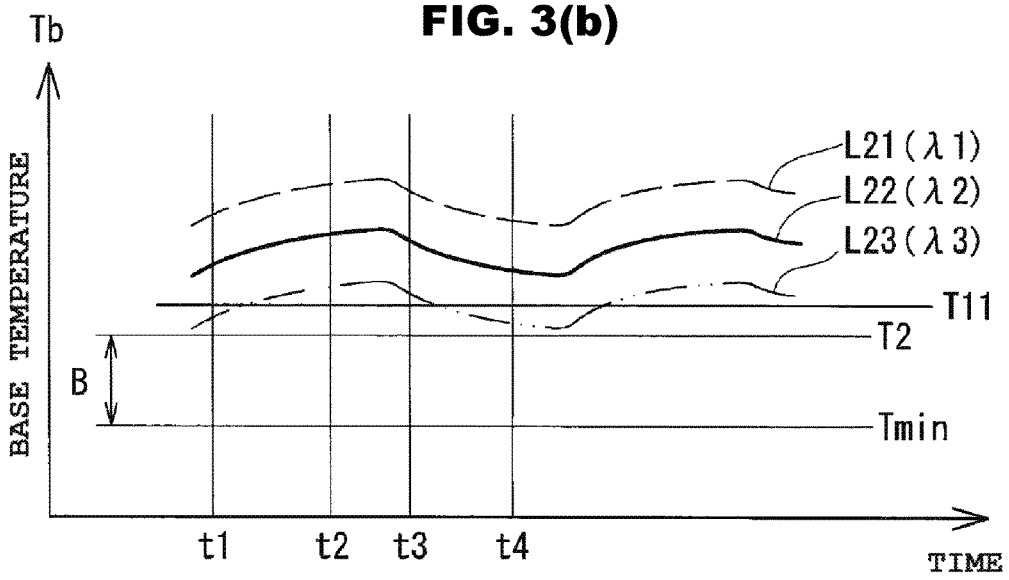

FIGS. 3(*a*) and 3(*b*) are graphs of an example of transition of the rotor temperature Tr and the base temperature Tb for a short period of time when heating and cooling (i.e., temperature adjustment) of the base portion are performed such that the rotor temperature Tr reaches the predetermined temperature T1. The "short period of time" as described herein is a time range of several minutes to several hours.

FIG. 3(*a*) is the graph of transition of the rotor temperature Tr. As described above, the predetermined temperature T1 is a control target value of the rotor temperature Tr in temperature adjustment of the base portion. Curved lines L21, L22, L23 of FIG. 3(*b*) indicate transition of the base temperature Tb. The curved lines L21, L22, L23 are different from each other in a gas type to be exhausted. Reference characters "λ1," "λ2," and "λ3" each represent a coefficient of thermal conductivity of gas, and are in a magnitude relationship of λ1>λ2>λ3.

The pump rotor 4*a* rotates at high speed in gas to perform exhausting. Thus, the pump rotor 4*a* generates heat due to friction with the gas. On the other hand, a heat dissipation amount from the pump rotor 4*a* to the stationary blades and the stator depends on the coefficient of thermal conductivity of gas, and a higher coefficient of thermal conductivity of gas results in a greater heat dissipation amount. As a result, in the case of a lower coefficient of thermal conductivity of gas, the heat dissipation amount from the pump rotor 4*a* is smaller, and the rotor temperature Tr is higher. That is, for the same gas flow rate and the same base temperature Tb, a lower coefficient of thermal conductivity of gas results in a higher rotor temperature Tr.

In the present embodiment, heating and cooling of the base portion are controlled such that the rotor temperature Tr reaches the predetermined temperature T1, and therefore, a lower coefficient of thermal conductivity of gas results in a lower base temperature Tb. In the example of FIG. 3(*b*), λ1>λ2>λ3. Thus, the base temperature Tb is lowest in the curved line L23 of the thermal conductivity coefficient λ3, and the rotor temperature Tr increases in the order of the curved lines L22, L21.

When the predetermined temperature T1 is input to the input section 24 of FIG. 2, the predetermined temperature T1 is input from the input section 24 to the temperature control section 21. When the predetermined temperature T1 is input, the temperature control section 21 sets, to upper and lower temperatures with respect to the predetermined temperature T1, a target upper temperature limit TU (=T1+ΔT) and a target lower temperature limit TL (=T1−ΔT) for controlling ON/OFF of the heater 5 and the cooling device 7. Then, based on the input predetermined temperature T1 and the rotor temperature Tr, ON/OFF of the heater 5 and the cooling device 7 is controlled such that the rotor temperature Tr reaches the predetermined temperature T1.

When the rotor temperature Tr exceeds, in a positive direction, the target lower temperature limit TL at a point t1 of FIG. 3(*a*), the temperature control section 21 turns off the heater 5 in an ON state to stop heating. When heating of the base portion by the heater 5 is stopped, a heat transfer amount from the base portion (the stator 32) to the pump rotor 4*a* decreases, leading to a decrease in the rise rate of the rotor temperature Tr. Subsequently, when the rotor temperature Tr exceeds, in the positive direction, the target upper temperature limit TU at a point t2, the temperature control section 21 turns on the cooling device 7 to start cooling of the base portion. When the temperature of the stator 32 is decreased by cooling, heat is transferred from the pump rotor 4*a* to the stator 32. After a period of time from start of cooling, the rotor temperature Tr begins decreasing.

When the rotor temperature Tr decreases and exceeds, in a negative direction, the target upper temperature limit TU at a point t3, the temperature control section 21 turns off the cooling device 7. As a result, heat transfer from the cylindrical portion 42 to the stator 32 decreases, and the decline rate of the rotor temperature Tr gradually lowers. Subsequently, when the rotor temperature Tr exceeds, in the negative direction, the target lower temperature limit TL at a point t4, the temperature control section 21 turns on the heater 5 to resume heating of the base portion. When the temperature of the stator 32 is increased by heater heating, heat is transferred from the stator 32 to the cylindrical portion 42, and the rotor temperature Tr begins increasing. As described above, when the temperatures of the base 3 and the stator 32 is increased/decreased by heating/cooling of the base portion, the temperature (the rotor temperature Tr) of the pump rotor 4*a* accordingly increases/decreases.

Figure 4A:
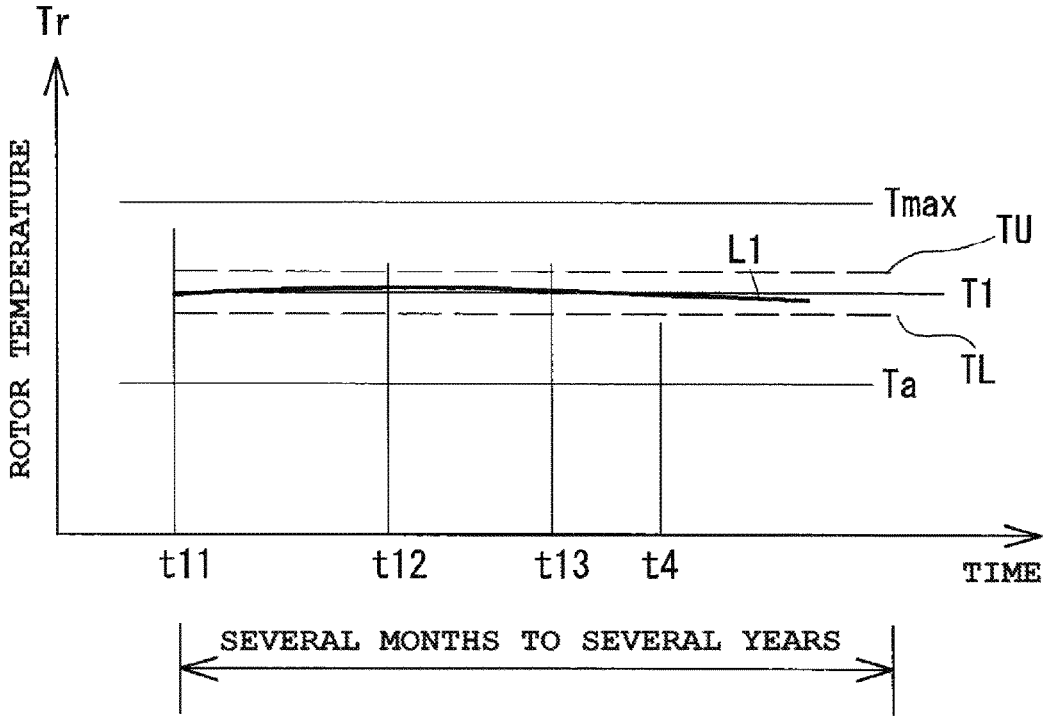
FIGS. 4(*a*) and 4(*b*) are graphs of an example of transition of the rotor temperature Tr and the base temperature Tb for a long period of time.
Figure 4B:
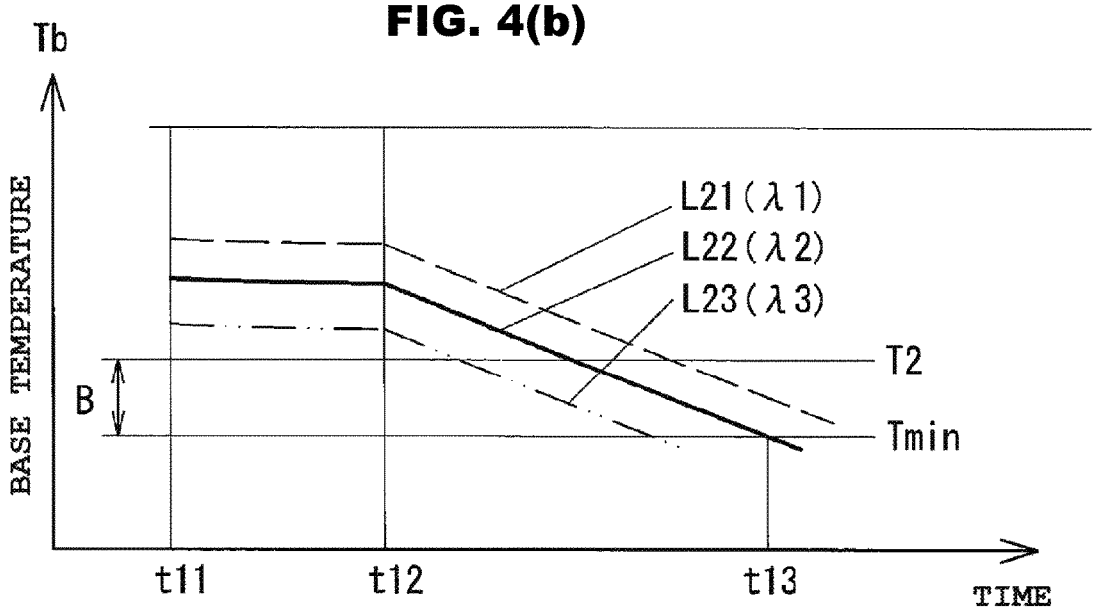

FIGS. 4(*a*) and 4(*b*) are graphs of an example of transition of the rotor temperature Tr and the base temperature Tb for a long period of time when heating and cooling of the base portion are performed such that the rotor temperature Tr reaches the predetermined temperature T1. The "long period of time" as described herein is a period of several months to several years. Accumulation of the reactive product is reduced by temperature adjustment of the base portion by the heater 5 and the cooling device 7, but such accumulation still gradually progresses.

As the gas flow path becomes narrower due to accumulation of the reactive product in the pump, the pressure of the turbine blade portion increases. With an increase in the pressure of the turbine blade portion, a motor current required for maintaining a rotor rotation speed at a rated rotation speed increases, and heat generation due to gas exhausting increases. As a result, the rotor temperature tends to increase. When the rotor temperature Tr tends to increase due to accumulation of the reactive product, temperature adjustment is performed such that the rotor temperature Tr reaches the predetermined temperature T1, and therefore, the amount of heating of the base portion decreases. That is, the base temperature Tb decreases with an increase in accumulation of the reactive product.

In the example shown in FIGS. 4(*a*) and 4(*b*), for a period of time after start of use of the pump at a point t11, the amount of accumulation of the reactive product is not an amount influencing the rotor temperature Tr, and for this reason, the base temperature Tb is substantially maintained constant. However, after a point t12 at which the amount of accumulation has been increased to some extent, the amount of heating of the base decreases to reduce an increase in the rotor temperature Tr, and the base temperature begins decreasing. Then, when the comparison section 22 of FIG. 2 detects that the base temperature Tb reaches equal to or lower than the predetermined temperature T2, the comparison section 22 outputs, to the display section 23, a warning signal for requesting maintenance, and outputs the warning signal to the outside via the output section 26. When the warning signal is input to the display section 23, the display section 23 displays a warning.

In addition, when the comparison section 22 detects that the base temperature Tb reaches an operable lower temperature limit Tmin, the comparison section 22 outputs the warning signal to the display section 23, and outputs a pump stop signal to the outside (e.g., the control unit of the turbo-molecular pump) via the output section 26. Upon input of the warning signal, the display section 23 displays a warning for stopping the pump. Further, when the pump stop signal is input to the control unit of the turbo-molecular pump, the turbo-molecular pump begins pump stop operation.

In FIGS. 3(*a*), 3(*b*), 4(*a*), and 4(*b*), a temperature Tmax is an operable upper temperature limit of the turbo-molecular pump. When the rotor temperature Tr exceeds the operable upper temperature limit Tmax, the creep strain of the pump rotor 4*a* can no longer be ignored, leading to greater influence on life shortening. For this reason, the predetermined temperature T1 is set to, e.g., TU<Tmax such that the rotor temperature Tr does not exceed the operable upper temperature limit Tmax. As long as the rotor temperature Tr is equal to or lower than the operable upper temperature limit Tmax, the influence of the creep strain is small, and therefore, the creep life of the pump rotor 4*a* can be maintained at equal to or greater than a predetermined value.

However, when the predetermined temperature T1 is set to an extremely-low temperature, the base temperature Tb in temperature adjustment is equal to or lower than the predetermined temperature T2, and the amount of accumulation of the reactive product increases, leading to a shorter maintenance interval. For this reason, the predetermined temperature T1 is, in an initial state, preferably set such that the curved lines L21, L22, L23 of the base temperature Tb show a higher temperature than the predetermined temperature T2, as shown in FIG. 4(*b*).

In the examples of FIGS. 3(*a*), 3(*b*), 4(*a*), and 4(*b*), a temperature Ta as a lower limit when the predetermined temperature T1 is set indicates a value obtained based on the assumption of the case up to the gas indicated by the curved line L23. A gas flow rate is set for one, which has the lowest coefficient of thermal conductivity, of plural types of gas to be exhausted, and then, the temperature Ta is set such that the position of the curved line L23 (the base temperature Tb) is slightly on a high-temperature side than the predetermined temperature T2 when the rotor temperature Tr reaches the temperature Ta. As described above, the temperature Ta is the lower limit of the rotor temperature Tr for not decreasing the base temperature Tb below the predetermined temperature T2.

The lower limit of the predetermined temperature T1 is such a lower temperature limit that the base temperature Tb does not fall below the predetermined temperature T2, and FIG. 3(*a*) illustrates the case where the predetermined temperature T1 is set to the lower limit. On the other hand, a curved line L1' of FIG. 3(*a*) indicates the case where the predetermined temperature T1 is set to an upper limit. In this case, the rotor temperature Tr is controlled to equal to or lower than the operable upper temperature limit Tmax. That is, the predetermined temperature T1 is set within a range indicated by a reference character "A" in FIG. 3(*a*). In the case where a temperature variation range of a curved line L1 is 2ΔT1, the temperature range A is Ta+ΔT≤T1≤Tmax−ΔT1. As shown in FIG. 3(*b*), for setting all of three types of curved lines L21, L22, L23 to exceed the predetermined temperature T2, the temperature Ta may be set as in Ta=T1−ΔT1.

Note that in the case where a gas type having a lower coefficient of thermal conductivity than that of a previously-assumed gas type is exhausted or even in the case where the standard predetermined temperature T1 is set regardless of gas type, the base portion temperature might, as a result, fall below the predetermined temperature T2 in the initial state. However, in such a case, a setting change for decreasing the value of the predetermined temperature T1 may be performed again.

The method for setting the predetermined temperature T1 may include, for example, a configuration in which a value giving the highest priority to the rotor life, i.e., a value of T1=Ta+ΔT', is set in advance as a default value of the predetermined temperature T1 and a user can input a desired value within a range of Ta+ΔT' T1≤Tmax−ΔT' via the input section 24. The user can set the predetermined temperature T1 according to the level of weighting on both of the rotor life and the maintenance interval. That is, trade-off can be properly made for the rotor life and the maintenance interval. Moreover, it is also configured such that a default value is set in advance for the predetermined temperature T2 and the user can input a desired value via the input section 25. For example, in this case, a temperature substantially equal to a target temperature set for a typical base temperature to perform temperature adjustment is set as the default value of the predetermined temperature T2.

Alternatively, the sublimation temperature of the reactive product or a temperature close to such a sublimation temperature may be used as the predetermined temperature T2. When the base temperature Tb falls below the predetermined temperature T2 as the sublimation temperature, the speed of accumulation of the reactive product sharply increases, and therefore, the warning prompting the maintenance is displayed.

Examples of the operable lower temperature limit Tmin include a base temperature increasing the probability of causing, e.g., contact between the cylindrical portion 42 and the stator 32 due to significant accumulation of the reactive product. However, it is difficult to exactly determine such abase temperature, and the base temperature is much susceptible to a process status or a pump condition. For this reason, the operable lower temperature limit Tmin is, only as a guide, set such that a temperature range B is equal to or lower than about 10° C. with respect to the predetermined temperature T2. Needless to say, the temperature Tmin may be determined by experiment or simulation under actual process conditions.

(Description of Rotor Temperature Sensor 8)

The rotor temperature sensor 8 is configured to detect, in a non-contact state, the temperature of the pump rotor 4*a*. Such a non-contact sensor includes various types of sensors. The rotor temperature sensor 8 of the present embodiment detects, as the inductance change, the change in the magnetic permeability of the target 9 provided at the pump rotor 4*a* and formed of the ferromagnetic body.

Figure 5:
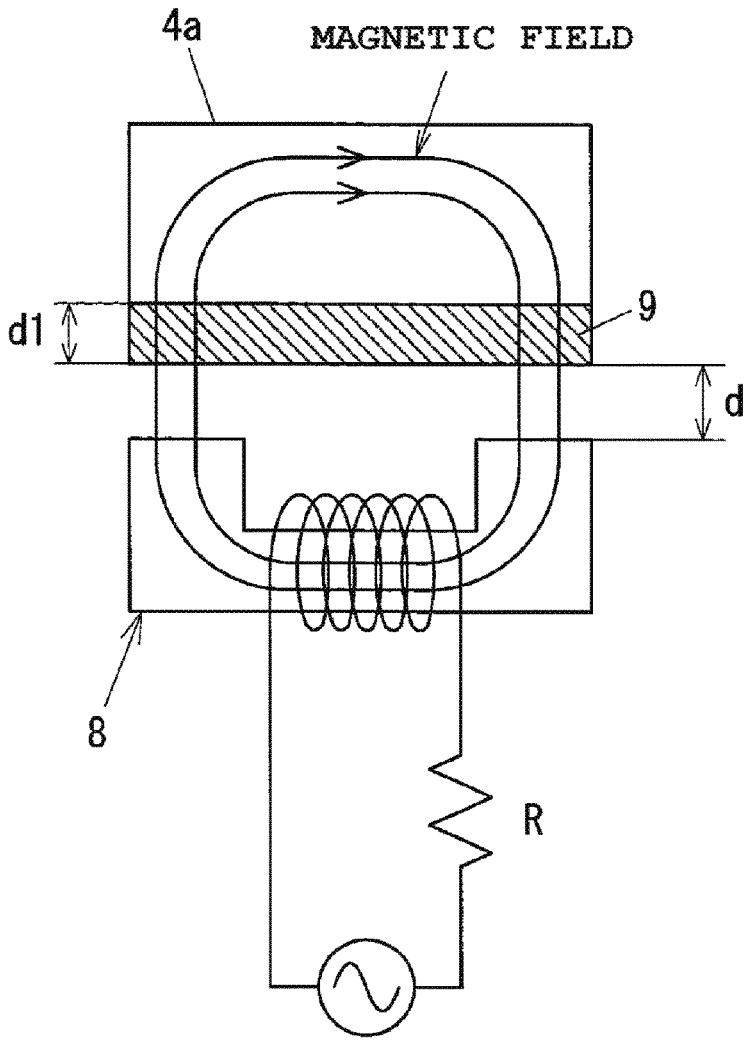
FIG. 5 is a diagram for describing a temperature detection principle of a rotor temperature sensor.

FIG. 5 is a diagram for describing a temperature detection principle of the rotor temperature sensor 8, and is a schematic diagram of a magnetic circuit including the rotor temperature sensor 8 and the target 9. The structure of the rotor temperature sensor 8 is made such that a coil is wound around a core having a great magnetic permeability, such as a silicon steel plate. A constant high-frequency voltage with a constant frequency is applied as a carrier wave to the coil of the rotor temperature sensor 8, and a high-frequency magnetic field is formed from the rotor temperature sensor 8 to the target 9.

For the target 9, a magnetic material having a Curie temperature Tc substantially equal to the operable upper temperature limit Tmax of the pump rotor 4*a* or close to the operable upper temperature limit Tmax is used. For example, the operable upper temperature limit Tmax in the case of aluminum is about 110° C. to 130° C., and examples of the magnetic material having a Curie temperature Tc of about 120° C. include nickel zinc ferrite and manganese zinc ferrite.

Figure 6A:
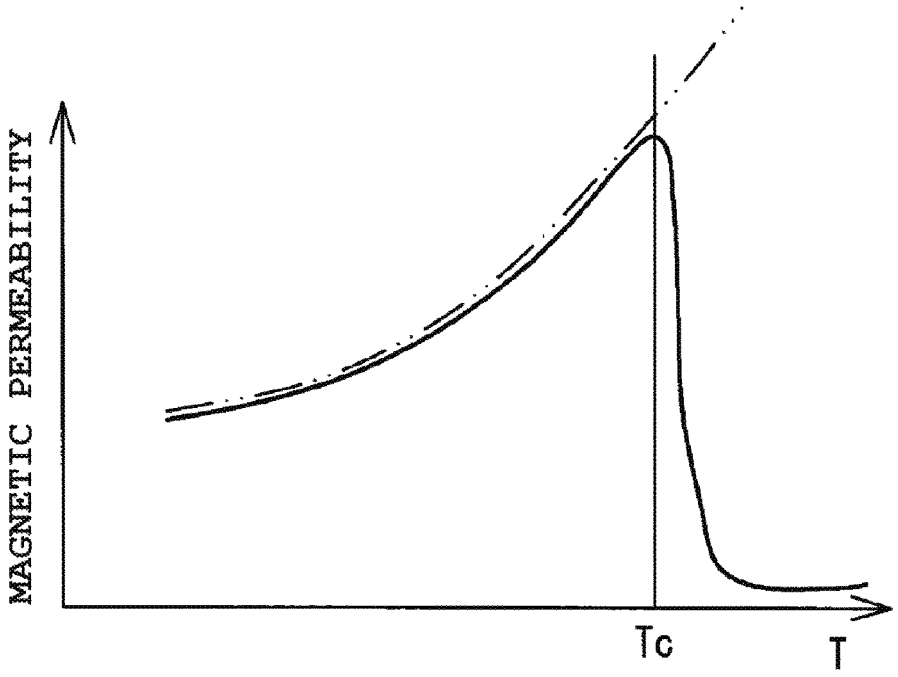
FIGS. 6(*a*) and 6(*b*) are graphs of an example of a magnetic permeability change and an inductance change at a Curie temperature Tc.
Figure 6B:
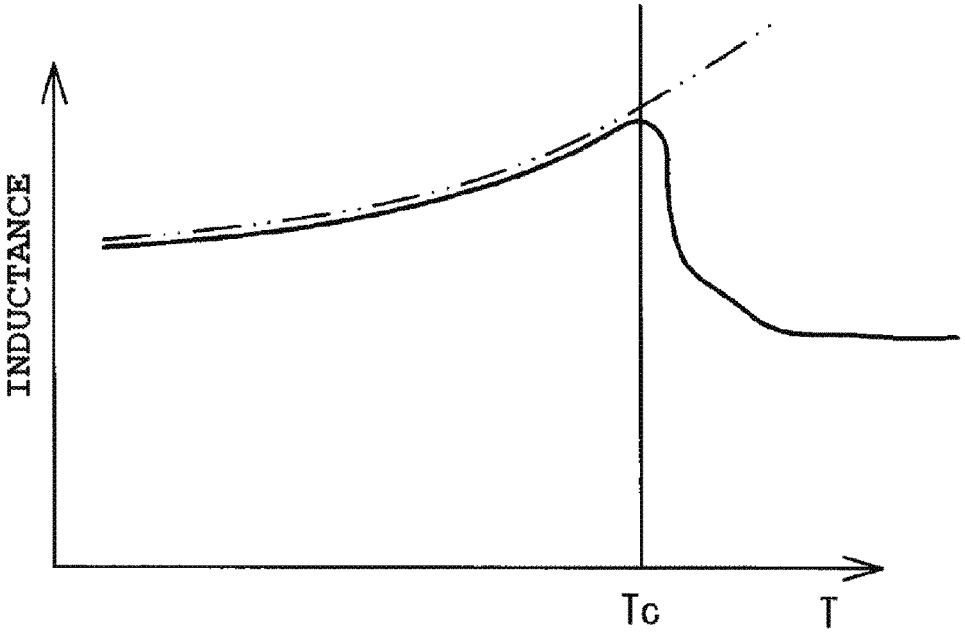

FIGS. 6(*a*) and 6(*b*) are graphs of an example of the magnetic permeability change and the inductance change at the Curie temperature Tc. When the temperature of the target 9 increases, due to a rotor temperature increase, to exceed the Curie temperature Tc, the magnetic permeability of the target 9 sharply drops to about a space permeability as indicated by a solid line of FIG. 6(*a*). FIG. 6(*a*) shows the magnetic permeability change in the case of ferrite as a typical magnetic body. The magnetic permeability of such a magnetic body at normal temperature is lower than that around the Curie temperature. Such a permeability increases with a temperature increase, and sharply drops at a temperature exceeding the Curie temperature Tc. When the magnetic permeability of the target 9 changes in the magnetic field formed by the rotor temperature sensor 8, the inductance of the rotor temperature sensor 8 changes. As a result, the amplitude of the carrier wave is modulated. The amplitude-modulated carrier wave output form the rotor temperature sensor 8 is detected and rectified, and in this manner, a signal change corresponding to the magnetic permeability change can be detected.

The magnetic body such as ferrite is used as the material of the core of the rotor temperature sensor 8. In the case where the magnetic permeability of such a magnetic body is, as compared to the magnetic permeability of an air gap, greater to such an extent that the magnetic permeability can be ignored and leakage flux can be ignored, a relationship among an inductance L and dimensions d, d1 is approximately indicated by the following expression (1). Note that "N" is the number of turns of the coil, "S" is the cross-sectional area of the sensor core facing the target 9, "d" is the air gap, "d1" is the thickness of the target 9, and "μ1" is the magnetic permeability of the target 9. Moreover, the magnetic permeability of the air gap is equal to a space permeability of μ0.

$$L=N^2/\{d1/(\mu 1\cdot S)+d/(\mu 0\cdot S)\} \quad (1)$$

When the rotor temperature Tr is lower than the Curie temperature Tc, the magnetic permeability of the target 9 is sufficiently greater than the space permeability. Thus, d1/(μ1·S) becomes less than d/(μ0·S) so that d1/(μ1·S) can be ignored. The expression (1) can be approximated as in the following expression (2):

$$L=N^2\cdot\mu 0\cdot S/d \quad (2)$$

On the other hand, when the rotor temperature Tr increases to exceed the Curie temperature Tc, μ1=μ0 is approximately obtained. Thus, in this case, the expression (1) is represented as in the following expression (3):

$$L=N^2\cdot\mu 0\cdot S/(d+d1) \quad (3)$$

That is, according to a change in the air gap from d to (d+d1), the inductance of the rotor temperature sensor 8 changes. Such an inductance change is detected so that it can be monitored whether or not the rotor temperature is equal to or higher than the Curie temperature Tc.

The magnetic permeability change shown in FIG. 6(*a*) is converted into the inductance change by the coil of the rotor temperature sensor 8, and the inductance changes as indicated by a solid line of FIG. 6(*b*). Although the inductance changes as in the magnetic permeability change, the rate of such a change is slightly lower than that of the magnetic permeability, and the inductance change shows a shape compressed in the vertical direction.

Chain double-dashed lines of FIGS. 6(*a*) and 6(*b*) indicate a magnetic permeability change and an inductance change of a pure iron target different from the target 9 formed of the ferromagnetic body. The Curie temperature Tc of the pure iron target is sufficiently higher than the Curie temperature Tc of the target 9, and therefore, the magnetic permeability and the inductance simply increase with a temperature increase in temperature ranges shown in FIGS. 6(*a*) and 6(*b*). When such a pure iron target is provided at the pump rotor 4*a*, a difference signal between an inductance signal for the target 9 and an inductance signal for the pure iron target is obtained as shown in FIG. 7.

Figure 7:
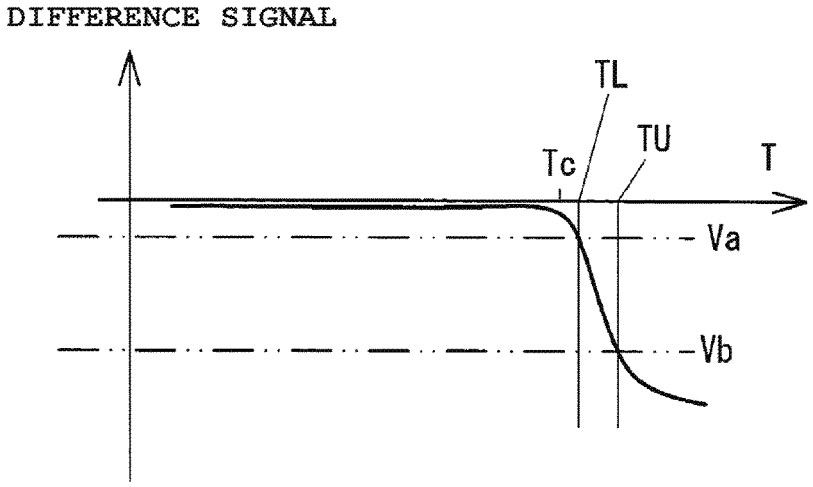
FIG. 7 is a graph for describing the method for setting temperatures TU, TL.

FIG. 7 is a graph for describing the method for setting the temperatures TU, TL. When two thresholds Va, Vb are set for the difference signal shown in FIG. 7, the difference signal has a value equal to or less than the threshold Va when the rotor temperature Tr is equal to or higher than TL, and has a value equal to or less than the threshold Vb when the rotor temperature Tr is equal to or higher than TU.

Figure 8:
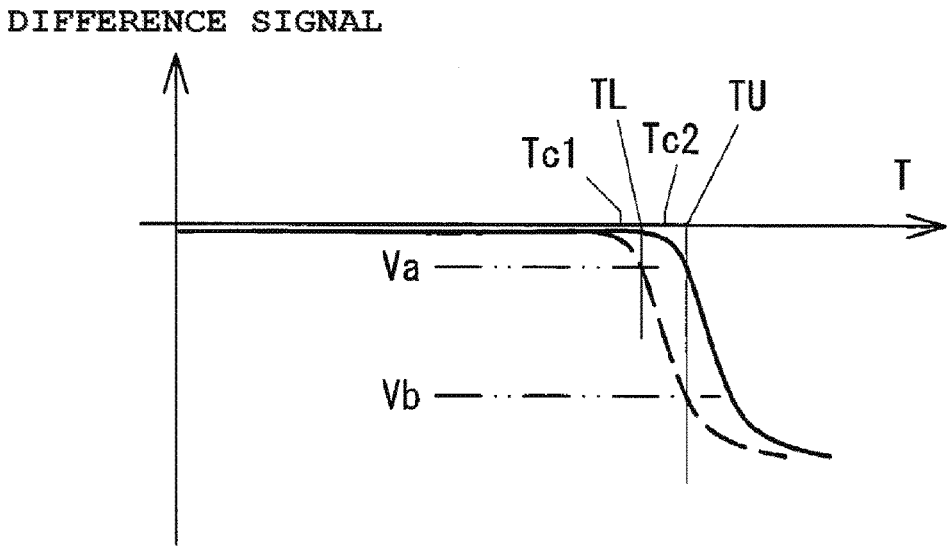
FIG. 8 is a graph for describing the method for setting the temperatures TU, TL in the case of using two targets.

Note that when it is difficult to obtain, as shown in FIG. 7, two temperature thresholds (TL, TU) due to an extremely-sharp magnetic permeability change around the Curie temperature Tc, two targets with different Curie temperatures Tc1, Tc2 as shown in FIG. 8 may be used, for example. A temperature threshold TL is obtained by the target with the Curie temperature Tc1 (<Tc2), and the temperature threshold TU is obtained by the target with the Curie temperature Tc2.

Figure 9:
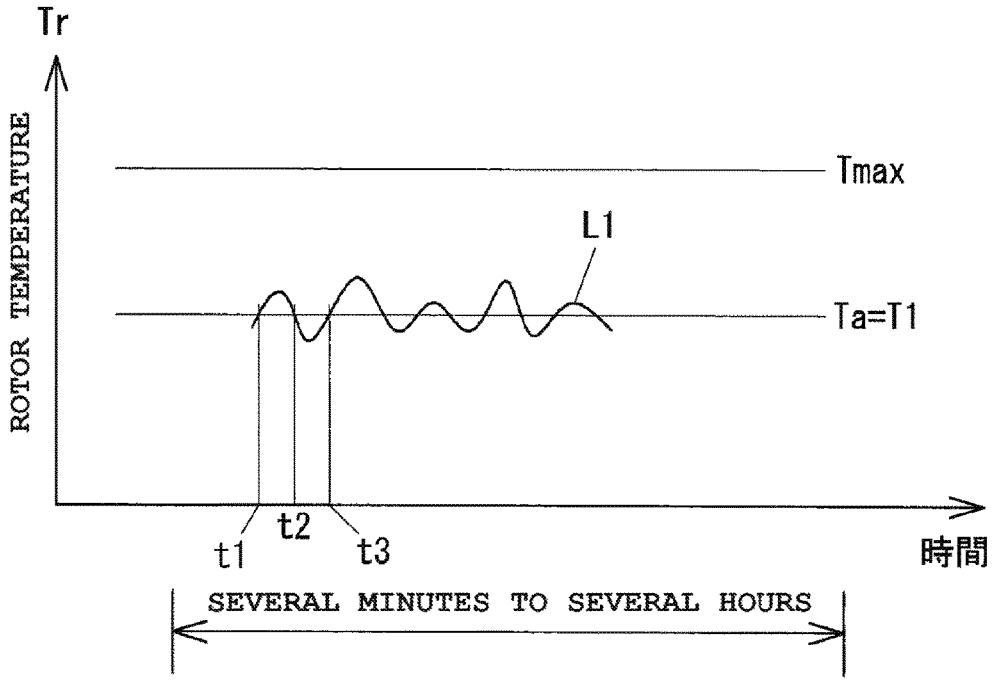
FIG. 9 is a graph for describing ON/OFF control using a single temperature threshold.

In the example shown in FIGS. 3(*a*) and 3(*b*), two temperature thresholds (TU, TL) are provided higher and lower with respect to the predetermined temperature T1, and the ON/OFF control of the heater 5 and the cooling device 7 is performed. However, the ON/OFF control may be performed using a single temperature threshold as shown in FIG. 9. In this case, the predetermined temperature T1 is set equal to the lower limit Ta. When the rotor temperature Tr exceeds, in the positive direction, the predetermined temperature T1 at the point t1, the heater 5 is turned off, and the cooling device 7 is turned on. As a result, the base temperature Tb decreases, and the rotor temperature Tr also decreases. Subsequently, when the rotor temperature Tr exceeds, in the negative direction, the predetermined temperature T1 at the point t2, the heater 5 is turned on, and the cooling device 7 is turned off. As a result, the base temperature Tb increases, and the rotor temperature Tr also increases.

In the above-described embodiment, the ON/OFF control of the heater 5 and the cooling device 7 is performed such that the rotor temperature Tr reaches the predetermined temperature T1. However, the ON/OFF control of the heater 5 and the cooling device 7 may be performed such that the rotor temperature Tr is controlled within a predetermined temperature range.

For example, two ferromagnetic targets having different Curie temperatures are, as in the case of FIG. 8, used to detect timing at which the rotor temperature Tr reaches the temperatures TU, TL. When the rotor temperature Tr exceeds the temperature TU, the amount of heating of the pump base portion is decreased. When the rotor temperature Tr falls below the temperature TL, the amount of heating of the pump base portion is increased such that the rotor temperature Tr is within a temperature range of equal to or higher than TL and equal to or lower than TU. The temperature TU is set to equal to or lower than the operable upper temperature limit Tmax, and the temperature TL is set higher than the temperature Ta of FIG. 3. Thus, the rotor life is extended due to a rotor temperature Tr of equal to or lower than the operable upper temperature limit Tmax, and accumulation of the reactive product is reduced due to the base temperature Tb held higher than the predetermined temperature T2.

When a pump operation time is over a long period of time, the amount of accumulation of the reactive product increases, and the base temperature Tb decreases as in the case of FIG. 4(*a*). Then, when the base temperature Tb reaches equal to or lower than the predetermined temperature T2, the warning for maintenance is generated. Further, when the base temperature Tb reaches the operable lower temperature limit Tmin, the warning signal is output to the display section 23, and the pump stop signal is output from the output section 26.

(1) As described above, the temperature control device 2 of the present embodiment is the temperature control device of the turbo-molecular pump including the stator 32 provided at the base 3 as the pump base portion, the pump rotor 4*a* rotatably driven on the stator 32, the heater 5 configured to heat the base 3, the base temperature sensor 6 configured to detect the temperature of the base 3, and the rotor temperature sensor 8 configured to detect a temperature equivalent as a physical amount equivalent to the temperature of the pump rotor 4*a*. Such a temperature control device 2 includes the temperature control section 21 configured to control heating of the base 3 by the heater 5 based on the detection value of the rotor temperature sensor 8, and the display section 23 and the output section 26 as an informing section configured to inform the warning when the detection temperature of the base temperature sensor 6 is equal to or lower than the predetermined threshold (e.g., the predetermined temperature T2).

Since the temperature control section 21 controls heating of the base 3 by the heater 5 based on the detection value of the rotor temperature sensor 8, heater heating can be performed such that the rotor temperature Tr of the pump rotor 4*a* does not exceed the operable upper temperature limit Tmax. When the rotor temperature Tr tends to increase due to accumulation of the reactive product, an increase in the rotor temperature is suppressed by the above-described heating control, and the base temperature Tb tends to gradually decrease. As a result, an increase in the amount of accumulation of the reactive product can be detected as a decrease in the base temperature Tb. When the base temperature Tb reaches equal to or lower than predetermined temperature T2, the timing of the maintenance for removing the reactive product is informed. Thus, disadvantages due to accumulation of the reactive product, such as fixing of the pump rotor 4*a* and the stator 32 and contact of the pump rotor 4*a* with the stator 32 during rotation, can be prevented.

(2) Heating of the base 3 by the heater 5 is preferably controlled such that the detection value of the rotor temperature sensor 8 reaches the predetermined temperature T1 as a predetermined target value. By such control, the rotor temperature Tr can be set close to the operable upper temperature limit Tmax, and the base temperature Tb can be set as high as possible. As a result, the interval of the maintenance for removing the reactive product can be extended to the maximum extent.

(3) In the above-described embodiment, the temperature control device 2 is the temperature control device of the turbo-molecular pump including the stator provided at the base 3 as the pump base portion, the pump rotor 4*a* rotatably driven on the stator, the heater 5 configured to heat the base 3, and the rotor temperature sensor 8 configured to detect the temperature equivalent as the physical amount equivalent to the temperature of the pump rotor 4*a*. Heating of the base 3 is controlled such that the detection value of the rotor temperature sensor 8 reaches the predetermined target value (e.g., the predetermined temperature T1).

As described above, in the configuration in which heating of the base 3 is controlled such that the rotor temperature Tr reaches the predetermined target value, the base temperature Tb can be held higher in such a manner that the rotor temperature Tr is set as close to the operable upper temperature limit Tmax as possible. Thus, the rotor life can be managed while accumulation of the reactive product can be reduced to the maximum extent. Consequently, the trade-off between extension of the rotor life and extension of the interval of the maintenance for removing the reactive product in the turbo-molecular pump can be optimized.

Note that in the above-described invention of JP-A-10-266991, a base temperature target value is set by estimated calculation based on a rotor temperature, and base heating is controlled to the base temperature target value. In the configuration in which the base temperature target value is estimated from the rotor temperature as described above, the estimated calculation is complicated. Further, a base temperature is controlled to the base temperature target value, and this prevents the rotor temperature from being a high temperature. Thus, such a configuration has no advantage over the present embodiment in terms of a rotor temperature control accuracy.

(4) The rotor temperature detection section includes the ferromagnetic target 9 provided at the pump rotor 4*a*, and the rotor temperature sensor 8 disposed to face the target 9 to detect the magnetic permeability change of the target 9, and the temperature of the pump rotor 4*a* is detected based on the magnetic permeability change of the target 9 around the Curie point thereof. With such a configuration of the rotor temperature detection section, the rotor temperature Tr can be detected regardless of the type of gas to be exhausted.

Note that the method for detecting the rotor temperature Tr in the non-contact state is not limited to the above-described method using the magnetic permeability change at the Curie point of the ferromagnetic body, and includes various methods. For example, as described in JP-A-10-266991, the temperature of the rotor blade may be estimated by calculation based on the amount of change in the length of the rotor blade in the levitation direction thereof before and after thermal expansion and the amount of change in the length of a main shaft of the rotor blade in the levitation direction thereof before and after thermal expansion.

JP-A-10-266991 describes the configuration in which the temperature of the rotary blade is estimated based on a temperature difference between the temperature of gas at a suction port and the temperature of gas at a discharge port. However, in this case, the type of gas to be exhausted, i.e., the coefficient of thermal conductivity of gas, needs to be specified. When the gas type is unclear, an error is caused in temperature estimation.

On the other hand, in the case of the above-described temperature detection method using the magnetic permeability change at the Curie point of the ferromagnetic body, the rotor temperature can be detected regardless of the gas type, and therefore, the rotor life can be properly managed.

Figure 10:
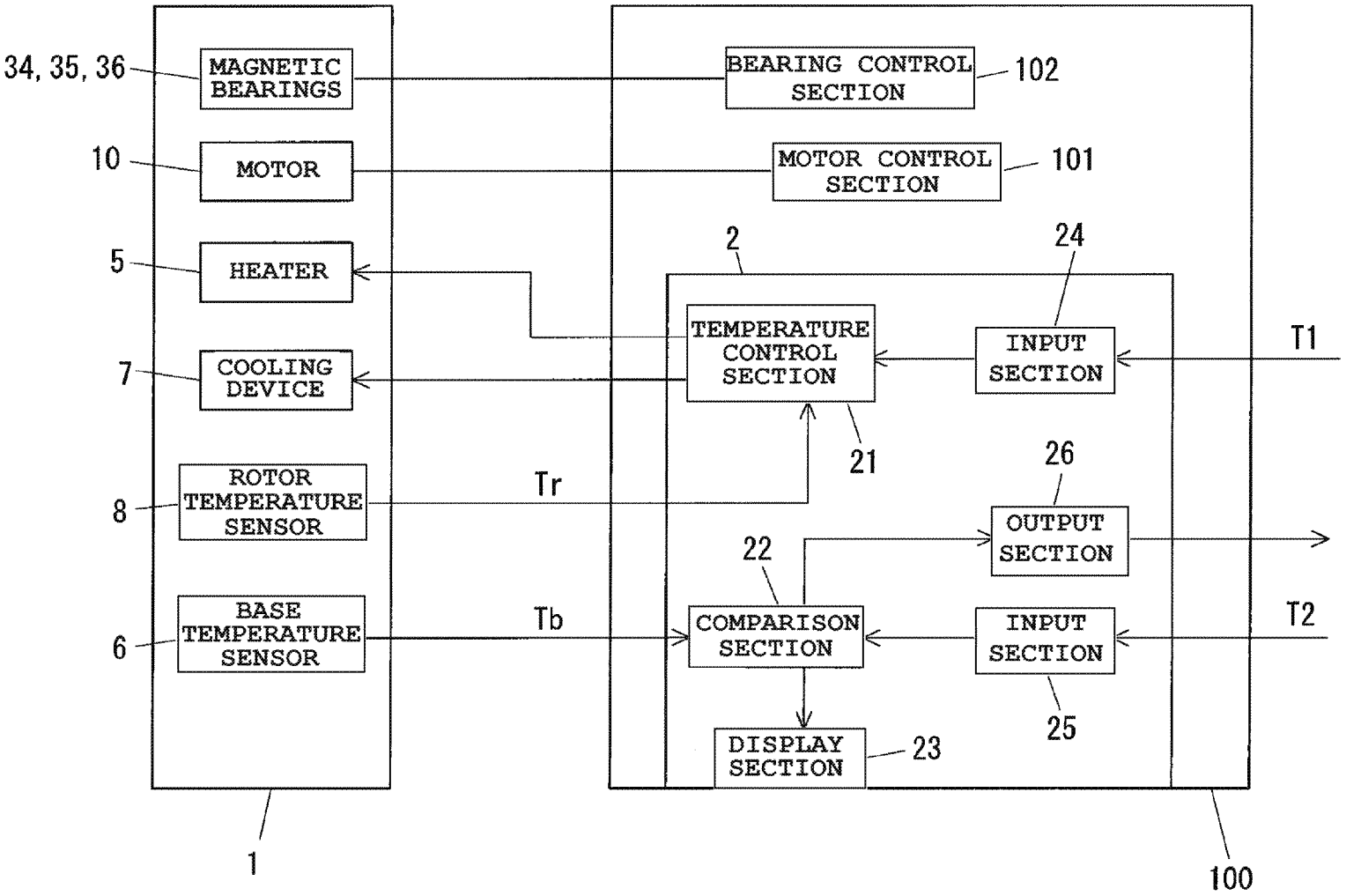
FIG. 10 is a block diagram of an example of the turbo-molecular pump including a temperature control device.

(5) In the configuration illustrated in FIG. 2, the temperature control device 2 is provided separately from the turbo-molecular pump to obtain, from a pump side, the temperature equivalent as the physical amount equivalent to the rotor temperature Tr and the base temperature Tb of the base 3. Then, ON/OFF of the heater 5 and the cooling device 7 is controlled by the temperature control section 21 of the temperature control device 2. However, the function of the temperature control device 2 may be built in a controller unit 100 of the turbo-molecular pump as illustrated in FIG. 10. The controller unit 100 is provided with a motor control section 101 configured to drive and control the motor 10 of the pump main body 1 and a bearing control section 102 configured to supply electromagnetic current to the magnetic bearings 34, 35, 36.

Various embodiments and variations have been described above, but the present invention is not limited to these contents. Other aspects conceivable within the scope of the technical idea of the present invention are included in the scope of the present invention.

What is claimed is:

1. A temperature control device of a turbo-molecular pump including a stator provided at a pump base portion, a rotor rotatably driven on the stator, a heater configured to heat the pump base portion, a base temperature sensor configured to detect a temperature of the pump base portion, and a rotor temperature sensor configured to detect a temperature equivalent as a physical amount equivalent to a temperature of the rotor, comprising:

a heating controller configured to control heating of the pump base portion by the heater based on a detection value of the rotor temperature sensor; and an informing output configured to inform a warning when a detection temperature of the base temperature sensor is equal to or lower than a predetermined threshold.

2. The temperature control device according to claim 1, wherein the heating controller controls the heating of the pump base portion by the heater such that the detection value of the rotor temperature sensor reaches a predetermined target value.

3. The temperature control device according to claim 1, wherein the rotor temperature sensor includes a ferromagnetic target provided at the rotor, and a sensor disposed to face the ferromagnetic target to detect a magnetic permeability change of the ferromagnetic target, and the temperature of the rotor is detected based on the magnetic permeability change of the ferromagnetic target around a Curie point thereof.

4. A turbo-molecular pump comprising:

a stator provided at a pump base portion;

a rotor rotatably driven on the stator;

a heater configured to heat the pump base portion;

a base temperature sensor configured to detect a temperature of the pump base portion;

a rotor temperature sensor configured to detect a temperature equivalent as a physical amount equivalent to a temperature of the rotor; and the temperature control device according to claim 1.

5. A temperature control device of a turbo-molecular pump including a stator provided at a pump base portion, a rotor rotatably driven on the stator, a heater configured to heat the pump base portion, and a rotor temperature sensor configured to detect a temperature equivalent as a physical amount equivalent to a temperature of the rotor, wherein heating of the pump base portion by the heater is controlled such that a detection value of the rotor temperature sensor reaches a predetermined target value.

6. The temperature control device according to claim 5, wherein the rotor temperature sensor includes a ferromagnetic target provided at the rotor, and a sensor disposed to face the ferromagnetic target to detect a magnetic permeability change of the ferromagnetic target, and the temperature of the rotor is detected based on the magnetic permeability change of the ferromagnetic target around a Curie point thereof.

7. A turbo-molecular pump comprising:

a stator provided at a pump base portion;

a rotor rotatably driven on the stator;

a heater configured to heat the pump base portion;

a rotor temperature sensor configured to detect a temperature equivalent as a physical amount equivalent to a temperature of the rotor; and the temperature control device according to claim 5.

* * * * *